US005974997A

United States Patent [19]

Amburgey

[11] Patent Number: 5,974,997

[45] Date of Patent: Nov. 2, 1999

[54] CLOTHING ARTICLE HAVING A TRIMMED APPLIQUÉ AND METHOD FOR MAKING THE SAME

[76] Inventor: Terry Gene Amburgey, 1020 Cooks Crossing, Apartment 8, Milford, Ohio 45150

[21] Appl. No.: 09/027,653

[22] Filed: Feb. 23, 1998

[51] Int. Cl.[6] ..... D05B 03/12

[52] U.S. Cl. ..... 112/475.01; 112/475.08; 112/439

[58] Field of Search ..... 112/439, 475.01, 112/441, 475.08, 475.21, 475.22, 475.18; 2/244, 115, 243.1

[56] References Cited

U.S. PATENT DOCUMENTS

| | | | |
|---|---|---|---|
| 1,173,927 | 2/1916 | Burns . | |
| 1,741,620 | 12/1929 | Fixler . | |
| 3,040,332 | 6/1962 | Kleinwald . | |
| 3,525,104 | 8/1970 | Bonanno . | |
| 3,882,549 | 5/1975 | Gaburo . | |
| 4,325,999 | 4/1982 | Campman . | |
| 4,427,472 | 1/1984 | Trager . | |
| 4,837,864 | 6/1989 | Thill . | |
| 5,007,113 | 4/1991 | Bouadjadja . | |
| 5,099,773 | 3/1992 | Codos | 112/439 X |
| 5,241,919 | 9/1993 | LaGreca . | |
| 5,544,365 | 8/1996 | Mondy . | |
| 5,800,900 | 9/1998 | Mitchell | 2/244 X |

FOREIGN PATENT DOCUMENTS

| | | | |
|---|---|---|---|
| 52665 | 3/1985 | Japan | 112/439 |

*Primary Examiner*—Ismael Izaguirre
*Attorney, Agent, or Firm*—Dinsmore & Shohl LLP

[57] ABSTRACT

A decorative article and method for making an article is provided, the article having a base material, a decorative material covering a portion of the base material, and a trim material secured to the base material and the decorative material. The trim material is visible after application and during use of the article and serves to secure the decorative material to the base material as well as to frame the decorative material. Preferably, a portion of the trim material overlaps a portion of the decorative material, the two materials being secured by stitching along the overlapping portions. It is also preferred that the trim material be stitched to the base material along an outer edge and that the trim material be stitched to the decorative material along an inner edge.

12 Claims, 4 Drawing Sheets

CLOTHING ARTICLE HAVING A TRIMMED APPLIQUÉ AND METHOD FOR MAKING THE SAME

TECHNICAL FIELD OF THE INVENTION

This invention relates to the field of clothing articles having a base material and a decorative material applied thereto, and, more particularly, to clothing articles where the decorative material is bordered by and secured to a trim material, and wherein the trim material is secured to the base material.

BACKGROUND OF THE INVENTION

Over the years, a variety of clothing articles have been created having a cut-out decoration fastened to a larger piece of fabric. The process of adding such decorations to wearable garments is known in the clothing industry as "appliqué". The term "appliqué" also refers to the cut-out decoration itself which is applied to the larger piece of material. The most popular and common process for applying an appliqué is by the use of an embroidery machine to apply a very tight satin stitch that completely follows the outline of the appliqué to be held in place. This process prevents fraying of the edges of the appliqué. The satin stitch itself is normally of one color and can only be applied by an embroidery machine.

Other means for applying decorations to clothing and fabrics are also known in the art. For example, U.S. Pat. No. 3,882,549 discloses a method of applying lace trim to a garment by attaching the trim to a straight section of bias tape such as by stitching. The bias tape can then be formed to a desired curve and attached to the garment edge, the tape thereby serving to secure the lace to the garment. Alternatively, two sections of bias tape can be stitched to lace trim, and the garment edge slipped between the exposed edges of the bias tape sections and stitched thereto. The reference contemplates using this method to apply decorative material such as lace to a garment edge, such that the decorative material is secured by one of its edges to an edge of the garment.

U.S. Pat. No. 1,173,927 discloses an edging or hem for curtains that comprises a strip of material doubled upon itself to provide a hem having two side portions and an open pocket. The free edges of the strip of material are folded or tucked inwardly between the side portions of the hem and stitched thereto. Lace edging is stitched or sewn to the bottom of the hem portion and projects therefrom. The bottom end of the curtain material is inserted into the open pocket such that the end of the curtain is straddled and concealed by the hem. The hem portion is then sewn to the bottom end of the curtain material U.S. Pat. No. 5,241,919 discloses an appliqué that includes a chenille material having a decorative shape, a flexible backing material, and a polymer film. The flexible backing material is applied to the lower surface of the chenille material and the polymer film overlays the upper surface of the chenille material. Closely spaced stitching is used to secure the film and chenille material to the garment. The stitching covers and compresses portion of the film and chenille material along the edges of the chenille material. Unstitched portions of the film are removed from the upper surface of the chenille material and the finalized design comprises the stitched and unstitched portions of the chenille material.

U.S. Pat. No. 3,040,332 discloses embroidering a design on an article of clothing. Embroidery stitches are formed on the base fabric in accordance with a selected embroidery design and a face fabric is applied over the embroidered stitches. The face fabric is thin and of a diaphanous nature and is stitched to the base fabric following the outline edges of the embroidery design, thereby sharply delineating the embroidery design and giving it a three dimensional effect in relief. A white or neutral color can be used for the face fabric so that the color of the embroidery stitches are visible through the fabric, thereby enhancing the ornamental effect of the design.

While these references disclose the application of a decoration to an article of clothing or other fabric, it has not been known to cover a portion of clothing or fabric with a decorative material and use a trim material to secure the decorative material to the clothing or fabric. In addition, it has not been known to use this trim material in a decorative fashion such that it is visible and provides a decorative frame or border for all edges of the decorative material, thereby adding to the overall appearance and design of the clothing or fabric. Moreover, the use of a trim material to secure an appliqué to an article of clothing or a fabric eliminates the need to use an embroidery machine to secure the appliqué with tight satin stitching, as is currently known in the art. Furthermore, because a trim material can include a wide variety of patterns, colors, and material types, the use of a trim material provides for a greater number of decorative possibilities than does the satin stitch, which generally is only adjusted in terms of color.

SUMMARY OF THE INVENTION

It is an object of this invention to overcome the above-described limitations of the prior art.

Another object of the present invention is to provide an article with a decorative design that is framed or bordered by a decorative trim.

It is another object of the present invention to provide a decorative article having a trim material that secures the edges of a decorative design to the article while simultaneously providing a decorative border or frame for the design.

It is yet another object of the present invention to provide a method of securing an appliqué to a decorative article without the use of an embroidery machine.

A further object of the present invention is to allow for a number of decorative ways to secure an appliqué.

To achieve the foregoing and other objects in accordance with the purposes of the present invention as described above, a decorative article is provided having a base material, a decorative material, and a trim material. The decorative material has a top and bottom surface, at least a portion of the bottom surface covering the base material, and at least a portion of the top surface remaining uncovered and visible. The trim material has an interior surface and an exterior surface, at least a portion of the exterior surface remaining visible and uncovered. A first attachment material secures the trim material to the decorative material and a second attachment material secures the trim material to the base material. Preferably, the decorative material is secured to the trim material along all of its edges. It is also preferred that the first attachment material is a first stitching and the second attachment material is a second stitching.

A method of producing a decorative article is also disclosed wherein a base material, a trim material, and a decorative material are provided, at least a portion of the decorative material being placed over a portion of the base material. The trim material has a first portion and a second portion. The first portion is placed adjacent a portion of the decorative material and secured thereto, and the second portion is placed adjacent a portion of the base material and secured thereto. Preferably, the trim material is a bias fabric.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENTS

Figure 1:
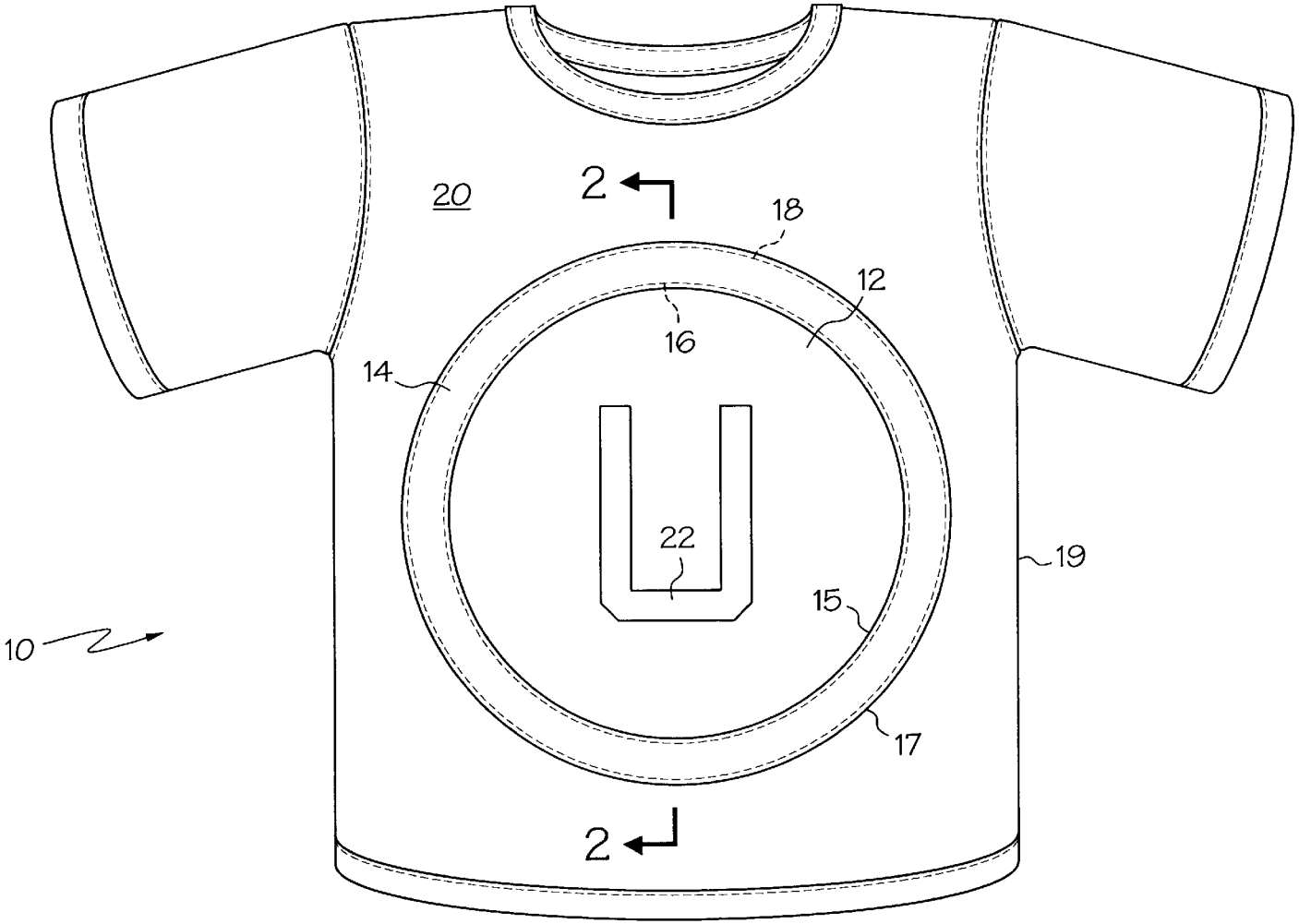
FIG. 1 is a front view of a decorative article made in accordance with a preferred embodiment of the present invention.

Referring now to the drawings in detail, wherein like numerals indicate the same elements throughout the views, FIG. 1 illustrates a preferred embodiment of the present invention in the form of decorative article 10 (e.g. a shirt, hat, coat, or other material having a decoration applied thereto) having a base material 20, a decorative material 12, and a trim material 14 for securing the decorative material to the base material. As shown in FIG. 1, the base material 20 preferably has a continuous portion that is not covered by the decorative material 12 or the trim material 14 such that the base material provides a backdrop for the trim material and the decorative material. Accordingly, it is preferred that a portion of the base material 20, a portion of the trim material 14, and a portion of the decorative material 12 are visible from the exterior of the decorative article 10 during use thereof; i.e., preferably, as shown in FIG. 2, portions of the exterior surface 23 of the base material, portions of the exterior surface 25 of the trim material, and portions of the exterior surface 28 of the decorative material remain uncovered following the application procedures, and remain visible in use of the decorated garment.

The base material 20 preferably is cut so as to be useful as an article of clothing, such as a tee-shirt as shown in FIG. 1. The material 20 can also be cut into other shapes for numerous uses, such as, for example, for use as garments and accessories such as sweatshirts, pants, hats, socks, jackets, scarves, sweatshirts and the like, or, for example, use in decorating other consumer items such as boat cover, draperies, blankets, umbrellas, carpeting, wall hangings, and luggage.

The decorative material 12 is preferably cut to a size and shape that will fit within the outer edge 19 of the base material 20 such that it can be used to cover at least a portion of the base material 20. Preferably, the decorative material 12 incorporates a design, symbol, pattern, or indicia, such as are typically applied to garments and clothing for aesthetic and/or identification purposes (e.g. indicia 22). The design or indicia may be applied to the material 12 in any manner known in the art, such as by sewing, printing, embroidering, and silk screening. Alternatively, the shape of the decorative material 12 itself may define the design or indicia to be displayed. In addition, while it is preferred that at least a portion of the decorative material 12 cover and hide from view a portion of the base material 20, the decorative material can be used as a patch to cover a hole or opening in the base material, thereby serving as a means of repairing the base material, connecting portions of the material, and/or as a means of reducing the cost of the article 10 by requiring less base material to be used.

Figure 2:
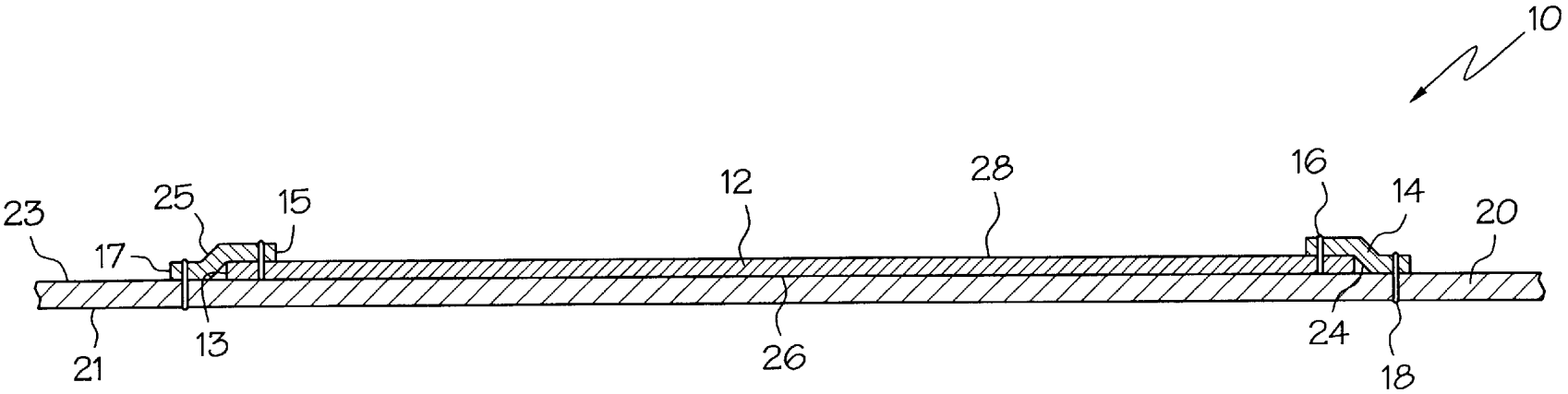
FIG. 2 is a cross-sectional view of the front surface of the decorative article of FIG. 1, such as taken along the line 2—2 thereof.

The trim material 14 is preferably a substantially unitary and/or unbroken strip of material having an inner edge 15 and an outer edge 17, as shown in the preferred embodiments of FIGS. 1 and 2. In a preferred arrangement, first stitching 16 is used to secure the decorative material 12 to the trim material 14 along the inner edge 15 of the trim material and the outer edge 13 of the decorative material. Likewise, trim material 14 is preferably secured to the base material 20 by second stitching 18 along the outer edge 17 of the trim material. Preferably, first stitching 16 and second stitching 18 comprise threads typically used in sewing garments and are applied through the use of a sewing machine.

In addition to stitching, it is to be understood that other attachment mechanisms for securing the trim material 14 to the decorative material 12 and base material 20 can be used, such as adhesives, rivets, double faced tape, or other attachment means. Moreover, a combination of attachment mechanisms might be desirable in some arrangements.

The inner edge 15 of the trim material 14 preferably defines a shape that is substantially similar to the shape defined by the outer edge 13 of the decorative material 12, yet is slightly smaller in area, such that the trim material can be used to frame the decorative material, as a mat would border or frame a picture. It is also preferred that portions of the trim material 14 near the inner edge 15 overlap portions of the decorative material 12 near the outer edge 13, and that the inner edge 15 be substantially coextensive with the outer edge 13, as shown in FIG. 2. More specifically, in the preferred configuration of FIG. 2, the interior surface 26 of the decorative material 12 is directly adjacent to the exterior surface 23 of the base material 20. Moreover, a portion of the interior surface 24 of the trim material 14 is directly adjacent to the exterior surface 28 of the decorative material 12 and the remaining portion of the interior surface 24 is directly adjacent to the exterior surface 23 of the base material 20. When the configuration of FIG. 2 is used, it is preferred that the trim material 14 be at least partially flexible so as to lay flat against both the decorative material 12 and the base material 20.

Figure 3:
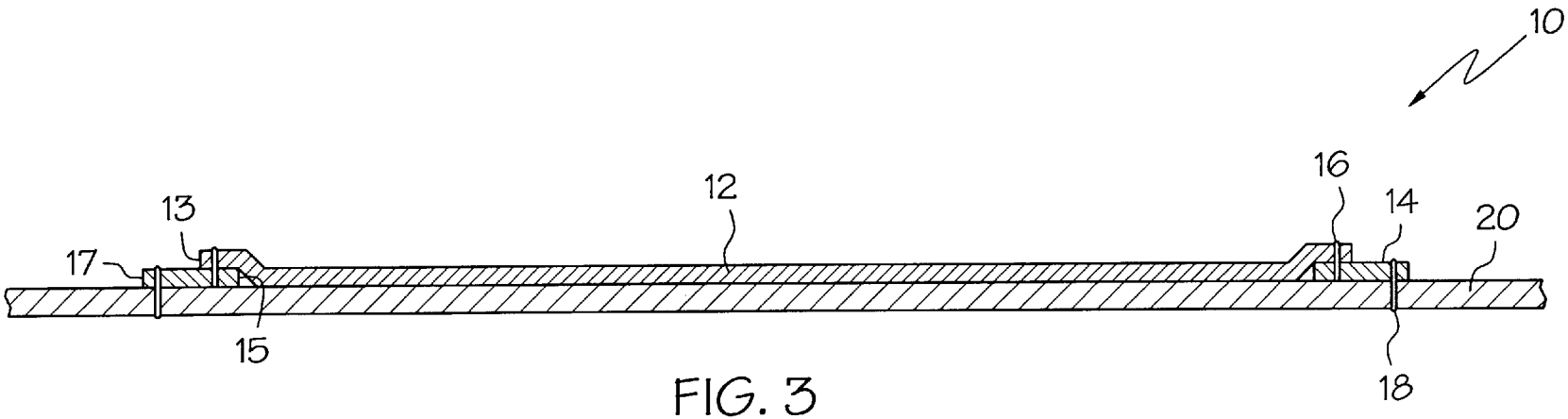
FIG. 3 is a cross-sectional view similar to FIG. 2, showing an alternate preferred embodiment of the present invention.

It is to be understood that, while the trim material 14 preferably borders and is secured to the entire outer edge of the decorative material 12 as shown in FIG. 1, the trim material 14 may border only portions or particular edges of the decorative material 12 without departing from the scope of the present invention. Furthermore, while it is preferred that the trim material 14 overlap the decorative material 12 as in FIG. 2, the decorative material can be configured to overlap the trim material such as is shown in the embodiment of FIG. 3. When an alternate configuration such as shown in FIG. 3 is utilized, portions of the trim material 14 near the inner edge 15 are overlapped by portions of the decorative material 12 near the outer edge 13. Thus, in the configuration of FIG. 3, trim material 14 lays flat against the base material 20 and is overlayed by the decorative material 12. As in FIG. 2, first stitching 16 can secure the trim material 14 to the decorative material 12 near the edges 13 and 15, and second stitching 18 can secure the trim material 14 to the base material 20 near the edge 17.

Alternatively, the trim material 14 may be a continuous piece of material with no interior aperture. The decorative material 12 may then be placed over the continuous piece of trim material 14 such that the entire interior surface 26 of the decorative material is in contact with the exterior surface 25 of the trim material, the outer edge 17 of the trim material extending from the outer edge 13 of the decorative material.

The base material 20, the decorative material 12, and the trim material 14 may comprise a variety of materials. It is preferred that the materials 12, 14, and 20 are stitchable fabrics or cloths made from materials typically used in garment manufacturing such as cotton, wool, silk, rayon, nylon, polyester, felt, and mixtures thereof. The materials may comprise other materials as well such as leather, vinyl, chenille, and plastic. Moreover, while the materials 12, 14, and 20 are preferably substantially continuous, they may comprise a plurality of materials or fabrics connected together, such as by use of stitching or adhesives. Decorative material 12 and trim material 14 can also be provided at numerous locations on the base material 20, such as in layers, as a repetitive pattern, or as letters making up a word.

Because the materials 12, 14, and 20 are to be visible after application (e.g. when the decorative article 10 is used), it is preferred that these materials incorporate colors, designs, images, patterns and/or indicia, so as to serve as a means of ornamenting and/or identifying the decorative article 10. A variety of patterns, colors, and types of trim material 14 can be used with a variety of patterns, colors, and types of decorative material 12, providing a virtually unlimited number of decorative combinations for the decorative article 10. It is particularly preferred that the trim material 14 incorporate such designs and that the designs be visible when viewing the exterior surface 25 of the trim material 14, so that the trim material 14 serves not only to secure the decorative material 12 to the base material 20 but also to simultaneously ornament and/or identify the decorative article 10. Such a design may comprise a woven or embroidered pattern, image, or indicia.

Figure 4:
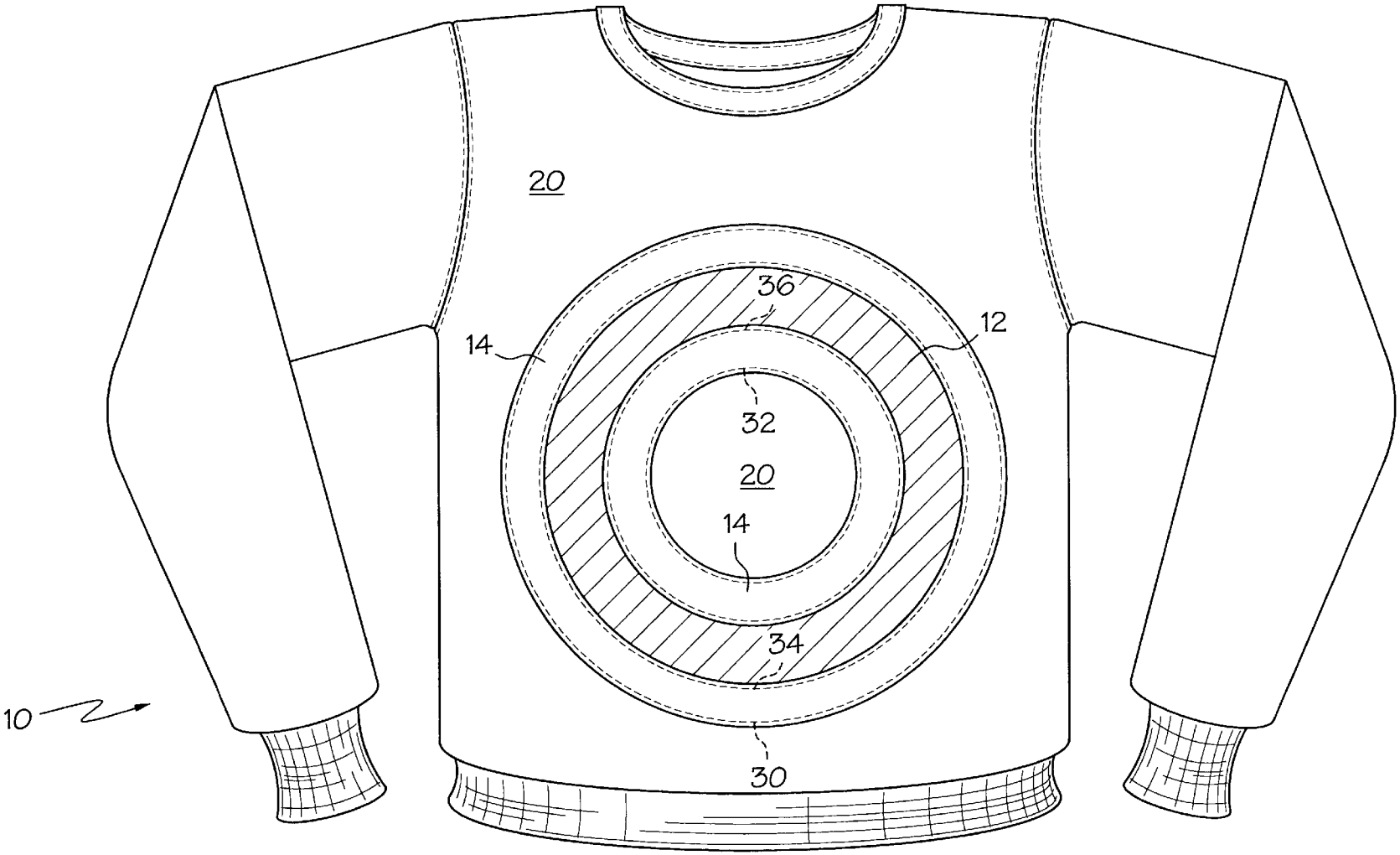
FIG. 4 is a front view of yet another decorative article made in accordance with a preferred embodiment of the present invention.

FIG. 4 depicts an additional preferred embodiment of the present invention. As exemplified by FIG. 4, it is contemplated that decorative material 12 may take on a variety of shapes and have a plurality of edges, any or all of which may be secured to the base material by trim material 14. In the embodiment shown in the figure, the decorative material 12 has an aperture provided in its interior such that it has two edges, an outer edge and an inner edge. Two portions of trim material 14 are provided to secure the two edges of the decorative material 12. Accordingly, four stitchings are also provided: stitchings 30 and 32 to secure the two trim materials 14 to the base material 20, and stitchings 34 and 36 to secure the two trim materials 14 to the decorative material 12.

Figure 5:
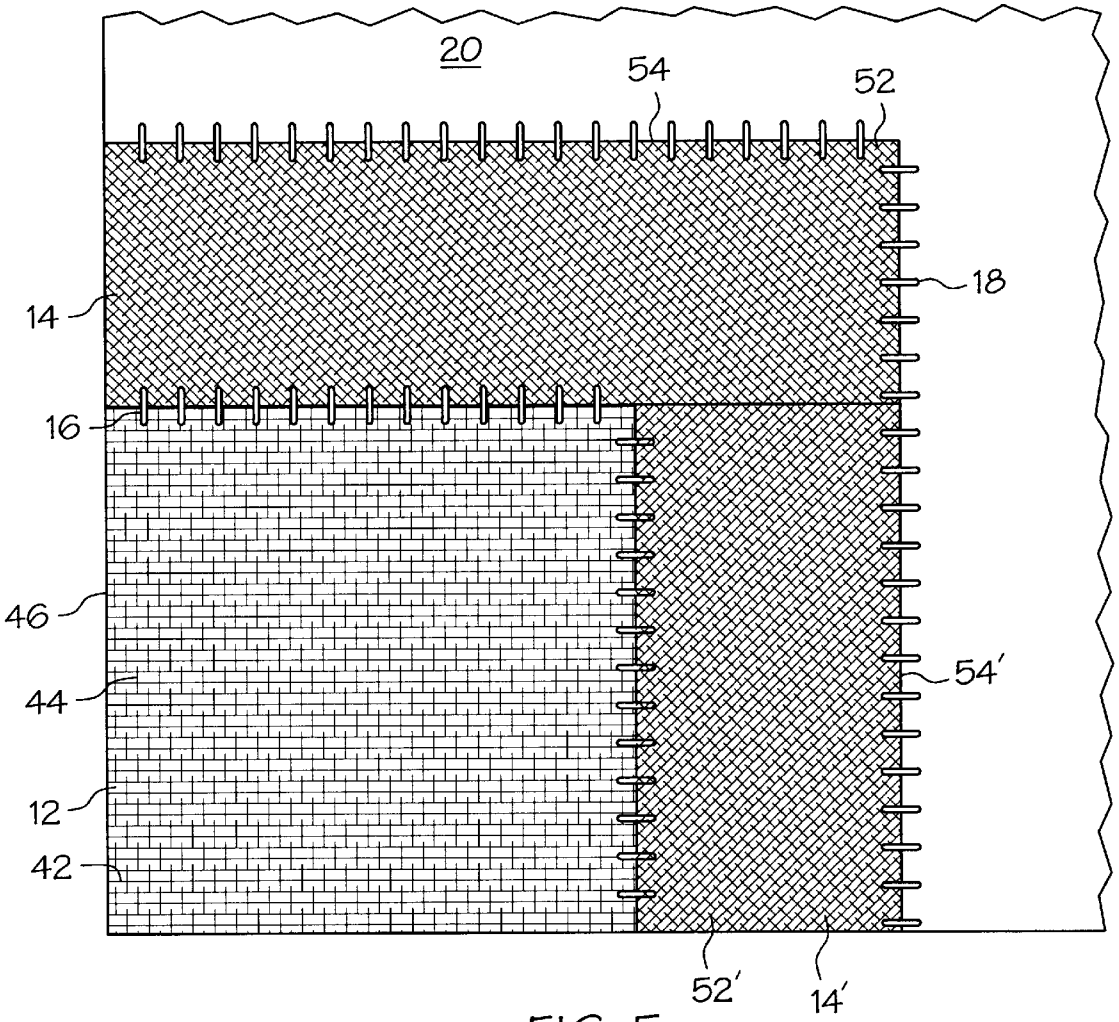
FIG. 5 is an enlarged plan view of a preferred embodiment of a trimmed applique according to the present invention.

It is preferred that the trim material 14 be a bias fabric comprising one or more plies of yarns or threads oriented at a bias relative to the direction of elongation of the fabric, such that the material is flexible and can easily be made to overlap the decorative material. As shown in the preferred embodiment of FIG. 5, trim materials 14 and 14' are bias materials while decorative material 12 is an appliqué made of a conventional fabric. Conventional fabrics, such as decorative material 12 of FIG. 5, are formed from threads or yarns which are oriented either along the long axis of the fabric or at right angles relative to the long axis. A conventional loom has reciprocating shuttles which traverse the width of the fabric so as to interweave transverse warp threads 42 with longitudinal fill threads 44, resulting in a conventional fabric of 0° and 90° thread orientation relative to the long axis 46 of the fabric.

However, it has been found that cutting or forming the fabric such that some or all of the threads are not perpendicular or parallel to the long axis of the fabric makes the material very flexible, and, thus, particularly well suited for use as a trim material, such as trim materials 14 and 14' of FIG. 5. A bias machine can be used to form a bias fabric wherein the threads of the fabric are oriented at angles, such as 30°, 45°, or 60° relative to the long axis of the fabric. Alternatively, bias fabric may be formed by cutting fabric at an angle relative to the weave of the fabric (i.e. relative to the threads making up the fabric). The threads 52 forming the trim material 14 are oriented at an angle (or bias) relative to the long axis 54 of the material. Similarly, the threads 52' forming the trim material 14' are oriented at an angle relative to the long axis 54' of the material. The threads are neither perpendicular nor parallel to the long axis of the fabric, but, rather, are at an angle to the axis. Preferably, this angle is approximately 45°. A method and apparatus for making such a bias fabric is disclosed in U.S. Pat. No. 4,325,999, the entire disclosure of which is hereby incorporated by reference.

As is also shown in FIG. 5, the first stitching 16, which secures the trim materials 14 and 14' to the decorative material 12, is independent and distinct from the second stitching 18, which secures the trim materials 14 and 14' to the base material 20.

The embodiment of FIGS. 1 and 2 can be made as follows: Decorative material 12 is provided in the desired shape, preferably with indicia 22. Trim material 14 is cut so that the inner edge 15 of the trim material defines a shape that is substantially similar to, but slightly smaller than, the shape defined by the outer edge 13 of the decorative material 12. The decorative material 12 is placed over the base material 20, a portion of the trim material 14 is placed over the decorative material, and another portion of the trim material is placed over the base material. The trim material 14 is stitched to the decorative material 12 with first stitching 16, and to the base material 20 with second stitching 18. A design or logo can then be applied to the decorative material 12 in a manner well known in the art, such as by silk-screening. Thus, the decorative material 12 can be applied to the base material 20 entirely by stitching and without the use of embroidery or satin stitching.

Having shown and described the preferred embodiments of the present invention, it is to be understood that further embodiments of articles of clothing and method described herein can be accomplished by appropriate modifications by one of ordinary skill in the art without departing from the scope of the present invention. A number of alternatives and modifications have been described herein, and others will be apparent to those skilled in the art. Accordingly, the scope of the present invention should be considered in terms of the following claims, and it is to be understood that this scope is not to be limited to the details of the structures and methods shown and described above.

What is claimed is:

1. A decorative article, comprising:

a base material;

a decorative material having a top surface and a bottom surface wherein at least a portion of the bottom surface covers a portion of the base material, and wherein at least a portion of the top surface remains uncovered and visible;

a trim material for securing the decorative material to the base material, the trim material having an interior surface and exterior surface, wherein at least a portion of the exterior surface remains uncovered and visible;

a first attachment material securing the trim material to the decorative material; and a second attachment material securing the trim material to the base material, wherein the decorative material has a plurality of edges, and wherein the decorative material is secured to the trim material along each of the edges by the first attachment material.

2. A decorative article, comprising:

a base material;

a decorative material having a top surface and a bottom surface, wherein at least a portion of the bottom surface covers a portion of the base material, and wherein at least a portion of the top surface remains uncovered and visible;

a trim material for securing the decorative material to the base material, the trim material having an interior surface and exterior surface, wherein at least a portion of the exterior surface remains uncovered and visible;

a first attachment material securing the trim material to the decorative material; and a second attachment material securing the trim material to the base material, wherein the first attachment material comprises a first stitching and the second attachment material comprises a second stitching, and wherein the base material has an outer surface and an inner surface, the bottom surface of the decorative material being directly adjacent the outer surface, a first portion of the interior surface of the trim material being directly adjacent the outer surface, and a second portion of the interior surface of the trim material being directly adjacent the top surface of the decorative material.

3. The article as recited in claim 2, wherein the first stitching secures adjacent portions of the trim material and the decorative material, and the second stitching secures adjacent portions of the trim material and base material.

4. A decorative article, comprising:

a base material;

a decorative material having a top surface and a bottom surface, wherein at least a portion of the bottom surface covers a portion of the base material, and wherein at least a portion of the top surface remains uncovered and visible;

a trim material for securing the decorative material to the base material, the trim material having an interior surface and exterior surface, wherein at least a portion of the exterior surface remains uncovered and visible;

a first attachment material securing the trim material to the decorative material; and a second attachment material securing the trim material to the base material, wherein the trim material further comprises a design visible on uncovered portions of the exterior surface of the trim material.

5. The article as recited in claim 4, wherein the design comprises a woven pattern integrally formed within the trim material.

6. A decorative article, comprising:

a base material;

a decorative material having a top surface and a bottom surface, wherein at least a portion of the bottom surface covers a portion of the base material, and wherein at least a portion of the top surface remains uncovered and visible;

a trim material for securing the decorative material to the base material, the trim material having an interior surface and exterior surface, wherein at least a portion of the exterior surface remains uncovered and visible;

a first attachment material securing the trim material to the decorative material; and a second attachment material securing the trim material to the base material, wherein the trim material is a bias fabric.

7. A decorative article, comprising:

a base material;

a decorative material having a top surface and a bottom surface, wherein at least a portion of the bottom surface covers a portion of the base material, and wherein at least a portion of the top surface remains uncovered and visible;

a trim material for securing the decorative material to the base material, the trim material having an interior surface and exterior surface, wherein at least a portion of the exterior surface remains uncovered and visible;

a first attachment material securing the trim material to the decorative material; and a second attachment material securing the trim material to the base material, wherein the first attachment material comprises a first stitching and the second attachment material comprises a second stitching, and wherein the first stitching extends along all edges of the decorative material.

8. A method of producing a decorative article, comprising:

providing a base material, a decorative material, and a trim material;

placing at least a portion of the decorative material over a portion of the base material;

placing a first portion of the trim material directly adjacent a portion of the decorative material;

securing the first portion of the trim material to the decorative material;

placing a second portion of the trim material directly adjacent a portion of the base material; and securing the second portion of the trim material to the base material.

9. The method as recited in claim 8, wherein the trim material has a first edge and a second edge, wherein the trim material is secured to the base material by stitching along the first edge, and wherein the trim material is secured to the decorative material by stitching along the second edge.

10. The method as recited in claim 8, wherein the trim material is a bias fabric.

11. The method as recited in claim 8, further comprising the step of applying a design to the decorative material.

12. The method as recited in claim 8, wherein the trim material is secured to the decorative material before the trim material is secured to the base material.

* * * * *